US006415253B1

(12) United States Patent
Johnson

(10) Patent No.: US 6,415,253 B1
(45) Date of Patent: Jul. 2, 2002

(54) METHOD AND APPARATUS FOR ENHANCING NOISE-CORRUPTED SPEECH

(75) Inventor: Steven A. Johnson, Norcross, GA (US)

(73) Assignee: Meta-C Corporation, Athens, GA (US)

( * ) Notice: Subject to any disclaimer, the term of this patent is extended or adjusted under 35 U.S.C. 154(b) by 0 days.

(21) Appl. No.: 09/253,640

(22) Filed: Feb. 19, 1999

Related U.S. Application Data

(60) Provisional application No. 60/075,435, filed on Feb. 20, 1998.

(51) Int. Cl.[7] ..... G10L 21/02

(52) U.S. Cl. ..... 704/210; 704/226; 381/94.2

(58) Field of Search ..... 704/210, 215, 704/226, 227, 228, 225; 381/94.1, 94.2, 94.3, 94.7

(56) References Cited

U.S. PATENT DOCUMENTS

| | | | | | |
|---|---|---|---|---|---|
| 5,133,013 | A | * | 7/1992 | Munday | 704/226 |
| 5,550,924 | A | * | 8/1996 | Helf et al. | 704/225 |
| 5,579,431 | A | * | 11/1996 | Reaves | 704/214 |
| 5,610,991 | A | * | 3/1997 | Janse | 381/94.7 |
| 5,659,622 | A | * | 8/1997 | Ashley | 704/227 |
| 5,706,395 | A | * | 1/1998 | Arslan et al. | 704/226 |
| 5,781,883 | A | * | 7/1998 | Wynn | 704/226 |
| 5,819,217 | A | * | 10/1998 | Raman | 704/233 |
| 5,864,806 | A | * | 1/1999 | Mokbel et al. | 704/234 |
| 5,878,389 | A | * | 3/1999 | Hermansky et al. | 704/226 |
| 5,937,375 | A | * | 8/1999 | Nakamura | 704/215 |
| 5,943,429 | A | * | 8/1999 | Handel | 704/226 |
| 5,963,899 | A | * | 10/1999 | Bayya et al. | 704/226 |
| 5,991,718 | A | * | 11/1999 | Malah | 704/233 |
| 6,122,610 | A | * | 9/2000 | Isabelle | 704/226 |

OTHER PUBLICATIONS

Hansen et al., "Constrained iterative speech enhancement with application to speech recognition," IEEE Transactions on Signal Processing, vol. 39, No. 4, Apr. 1991, pp. 795 to 805.*

Arslan et al., "New methods for adaptive noise suppression," 1995 International Conference on Acoustics, Speech, and Signal Processing, vol. 1, May 1995, pp. 812 to 815.*

Peter Handel, "Low–Distortion Spectral Subtraction for Speech Enhancement," Stockholm, Sweden, 4 pp. (undated).*

Oppenheim, A.V. et al., "Single Sensor Active Noise Cancellation Based on the EM Algorithm," Proc. IEEE, pp. 277–280 (Sep. 1992).

(List continued on next page.)

*Primary Examiner*—Marsha D. Banks-Harold
*Assistant Examiner*—Martin Lerner
(74) *Attorney, Agent, or Firm*—Sughrue Mion, PLLC

(57) ABSTRACT

A noise suppression device receives data representative of a noise-corrupted signal which contains a speech signal and a noise signal, divides the received data into data frames, and then passes the data frames through a pre-filter to remove a dc-component and the minimum phase aspect of the noise-corrupted signal. The noise suppression device appends adjacent data frames to eliminate boundary discontinuities, and applies fast Fourier transform to the appended data frames. A voice activity detector of the noise suppression device determines if the noise-corrupted signal contains the speech signal based on components in the time domain and the frequency domain. A smoothed Wiener filter of the noise suppression device filters the data frames in the frequency domain using different sizes of a window based on the existence of the speech signal. Filter coefficients used for Wiener filter are smoothed before filtering. The noise suppression device modifies magnitude of the time domain data based on the voicing information outputted from the voice activity detector.

15 Claims, 5 Drawing Sheets

OTHER PUBLICATIONS

Ephraim et al., "Spectrally–based Signal Subspace Approach for Speech Enhancement," Proc. IEEE, pp. 804–807 (May 1995).
Yang, "Frequency Domain Noise Suppression Approaches in Mobile Telephone Systems," Proc. IEEE, pp. 363–366 (Apr. 1993).
Ephraim, et al., "Signal Subspace Approach for Speech Enhancement," IEEE Transactions on Speech and Audio Processing, vol. 1, No. 4, Jul. 1995, pp. 251–265.
Hardwick et al., "Speech Enhancement Using the Dual Excitation Speech Model," Proc. IEEE, pp. 367–370 (Apr. 1993).
Lee et al., "Robust Estimation of AR Parameters and Its Application for Speech Enhancement," Proc. IEEE, pp. 309–312 (Sep. 1992).
George, "Single–Sensor Speech Enhancement Using a Soft–Decision/Variable Attenuation Algorithm," Proc. IEEE, pp. 816–819 (May 1995).
Virag, "Speech Enhancement Based on Masking Properties of the Auditory System," Proc. IEEE, pp. 796–799 (May 1995).
Tsoukalas et al., "Speech Enhancement Using Psychoacoustic Criteria," Proc. IEEE ICASSP, pp. 359–362 (Apr., 1993).
Azirani et al., "Optimizing Speech Enhancement by Exploiting Masking Properties of the Human Ear ," Proc. IEEE ICASSP, pp. 800–803 (May, 1995).
Hermansky et al., "Speech Enhancement Based on Temporal Processing," Proc. IEEE, pp. 405–408 (May 1995).
Sun et al., "Speech Enhancement Using a Ternary–Decision Based Filter," IEEE Proc. ICASSP, pp. 820–823 (May 1995).
Drygajlo et al., "Integrated Speech Enhancement and Coding in the Time–Frequency Domain," Proc. IEEE, pp. 1183–1185 (1997).
Arslan et al., "New Methods for Adaptive Noise Suppression," Proc. IEEE ICASSP, pp. 812–815 (May, 1995).

* cited by examiner

METHOD AND APPARATUS FOR ENHANCING NOISE-CORRUPTED SPEECH

This application claims the benefit of Provisional Application No. 60/075,435, filed on Feb. 20, 1998.

BACKGROUND OF THE INVENTION

1. Field of the Invention

The present invention relates generally to a method and an apparatus for enhancing noise-corrupted speech through noise suppression. More particularly, the invention is directed to improving the speech quality of a noise suppression system employing a spectral subtraction technique.

2. Description of the Related Art

With the advent of digital cellular telephones, it has become increasingly important to suppress noise in solving speech processing problems, such as speech coding and speech recognition. This increased importance results not only from customer expectation of high performance even in high car noise situations, but also from the need to move progressively to lower data rate speech coding algorithms to accommodate the ever-increasing number of cellular telephone customers.

The speech quality from these low-rate coding algorithms tends to degrade drastically in high noise environments. Although noise suppression is important, it should not introduce undesirable artifacts, speech distortions, or significant loss of speech intelligibility. Many researchers and developers have attempted to achieve these performance goals for noise suppression for many years, but these goals have now come to the forefront in the digital cellular telephone application.

In the literature, a variety of speech enhancement methods potentially involving noise suppression have been proposed. Spectral subtraction is one of the traditional methods that has been studied extensively. See, e.g., Lim, "Evaluations of Correlation Subtraction Method for Enhancing Speech Degraded by Additive White Noise," IEEE Trans. Acoustics, Speech and Signal Processing, Vol. 26, No. 5, pp. 471–472 (1978); and Boll, "Suppression of Acoustic Noise in Speech Using Spectral Subtraction," IEEE Trans. Acoustics, Speech and Signal Processing, Vol. 27, No. 2, pp. 113–120 (April, 1979). Spectral subtraction is popular because it can suppress noise effectively and is relatively straightforward to implement.

In spectral subtraction, an input signal (e.g., speech) in the time domain is converted initially to individual components in the frequency domain, using a bank of band-pass filters, typically, a Fast Fourier Transform (FFT). Then, the spectral components are attenuated according to their noise energy.

The filter used in spectral subtraction for noise suppression utilizes an estimate of power spectral density of the background noise, thereby generating a signal-to-noise ratio (SNR) for the speech in each frequency component. Here, the SNR means a ratio of the magnitude of the speech signal contained in the input signal, to the magnitude of the noise signal in the input signal. The SNR is used to determine a gain factor for a frequency component based on a SNR in the corresponding frequency component. Undesirable frequency components then are attenuated based on the determined gain factors. An inverse FFT recombines the filtered frequency components with the corresponding phase components, thereby generating the noise-suppressed output signal in the time domain. Usually, there is no change in the phase components of the signal because the human ear is not sensitive to such phase changes.

This spectral subtraction method can cause so-called "musical noise." The musical noise is composed of tones at random frequencies, and has an increased variance, resulting in a perceptually annoying noise because of its unnatural characteristics. The noise-suppressed signal can be even more annoying than the original noise-corrupted signal.

Thus, there is a strong need for techniques for reducing musical noise. Various researchers have proposed changes to the basic spectral subtraction algorithm for this purpose. For example, Berouti et al., "Enhancement of Speech Corrupted by Acoustic Noise," Proc. IEEE ICASSP, pp. 208–211 (April, 1979) relates to clamping the gain values at each frequency so that the values do not fall below a minimum value. In addition, Berouti et al. propose increasing the noise power spectral estimate artificially, by a small margin. This is often referred to as "oversubtraction."

Both clamping and oversubtraction are directed to reducing the time varying nature associated with the computed gain modification values. Arslan et al., "New Methods for Adaptive Noise Suppression," Proc. IEEE ICASSP, pp. 812–815 (May, 1995), relates to using smoothed versions of the FFT-derived estimates of the noisy speech spectrum, and the noise spectrum, instead of using the FFT coefficient values directly. Tsoukalas et al., "Speech Enhancement Using Psychoacoustic Criteria," Proc. IEEE ICASSP, pp. 359–362 (April, 1993), and Azirani et al., "Optimizing Speech Enhancement by Exploiting Masking Properties of the Human Ear," Proc. EEE ICASSP, pp. 800–803 (May, 1995), relate to psychoacoustic models of the human ear.

Clamping and oversubtraction significantly reduce musical noise, but at the cost of degraded intelligibility of speech. Therefore, a large degree of noise reduction has tended to result in low intelligibility. The attenuation characteristics of spectral subtraction typically lead to a de-emphasis of unvoiced speech and high frequency formants, thereby making the speech sound muffled.

There have been attempts in the past to provide spectral subtraction techniques without the musical noise, but such attempts have met with limited success. See, e.g., Lim et al., "All-Pole Modeling of Degraded Speech," IEEE Trans. Acoustic, Speech and Signal Processing, Vol. 26, pp. 197–210 (June, 1978); Ephraim et al., "Speech Enhancement Using a Minimum Mean Square Error Short-Time Spectral Amplitude Estimator," IEEE Trans. Acoustics, Speech and Signal Processing, Vol. 32, pp. 1109–1120 (1984); and McAulay et al., "Speech Enhancement Using a Soft-Decision Noise Suppression Filter," IEEE Trans. Acoustic, Speech and Signal Processing, Vol. 28, pp. 137–145 (April, 1980).

In spectral subtraction techniques, the gain factors are adjusted by SNR estimates. The SNR estimates are determined by the speech energy in each frequency component, and the current background noise energy estimate in each frequency component. Therefore, the performance of the entire noise suppression system depends on the accuracy of the background noise estimate. The background noise is estimated when only background noise is present, such as during pauses in human speech. Accordingly, spectral subtraction with high precision requires an accurate and robust speech/noise discrimination, or voice activity detection, in order to determine when only noise exists in the signal.

Existing voice activity detectors utilize combinations of energy estimation, zero crossing rate, correlation functions, LPC coefficients, and signal power change ratios. See, e.g., Yatsuzuka, "Highly Sensitive Speech Detector and High-Speed Voiceband Data Discriminator in DSI-ADPCM Systems," IEEE Trans. Communications, Vol 30, No. 4 (April, 1982); Freeman et al., "The Voice Activity Detector for the Pan-European Digital Cellular Mobile Telephone Service," IEEE Proc. ICASSP, pp. 369–372 (February, 1989); and Sun et al., "Speech Enhancement Using a Ternary-Decision Based Filter," IEEE Proc. ICASSP, pp. 820–823 (May, 1995).

However, in very noisy environments, speech detectors based on the above-mentioned approaches may suffer serious performance degradation. In addition, hybrid or acoustic echo, which enters the system at significantly lower levels, may corrupt the noise spectral density estimates if the speech detectors are not robust to echo conditions.

Furthermore, spectral subtraction assumes noise source to be statistically stationary. However, speech may be contaminated by color non-stationary noise, such as the noise inside a compartment of a running car. The main sources of the noise are an engine and the fan at low car speeds, or the road and wind at higher speeds, as well as passing cars. These non-stationary noise sources degrade performance of speech enhancement systems using spectral subtraction. This is because the non-stationary noise corrupts the current noise model, and causes the amount of musical noise artifacts to increase. Recent attempts to solve this problem using Kalman filtering have reduced, but not eliminated, the problems. See, Lockwood et al., "Noise Reduction for Speech Enhancement in Cars: Non-Linear Spectral Subtraction/Kalman Filtering," EUROSPEECH91, pp. 83–86 (September, 1991).

Therefore, a strong need exists for an improved acoustic noise suppression system that solves problems such as musical noise, background noise fluctuations, echo noise sources, and robust noise classification.

SUMMARY OF THE INVENTION

These and other problems are overcome by the present invention, which has an object of providing a method and apparatus for enhancing noise-corrupted speech.

A system for enhancing noise-corrupted speech according to the present invention includes a framer for dividing the input audio signal into a plurality of frames of signals, and a pre-filter for removing the DC-component of the signal as well as alter the minimum phase aspect of speech signals.

A multiplier multiplies a combined frame of signals to produce a filtered frame of signals, wherein the combined frame of signals includes all signals in one filtered frame of signals combined with some signals in the filtered frame of signals immediately preceding in time the one filtered frame of signals. A transformer obtains frequency spectrum components from the windowed frame of signals. A background noise estimator uses the frequency spectrum components to produce a noise estimate of an amount of noise in the frequency spectrum components.

A noise suppression spectral modifier produces gain multiplicative factors based on the noise spectral estimate and the frequency spectrum components. A controlled attenuator attenuates the frequency spectrum components based on the gain multiplication factors to produce noise-reduced frequency components, and an inverse transformer converts the noise-reduced frequency components to the time-domain. The time domain signal is further gain modified to alter the signal level such that the peaks of the signal are at the desired output level.

More specifically, the first aspect of the present invention employs a voice activity detector (VAD) to perform the speech/noise classification for the background noise update decision using a state machine approach. In the state machine, the input signal is classified into four states: Silence state, Speech state, Primary Detection state, and Hangover state. Two types of flags are provided for representing the state transitions of the VAD. Short term energy measurements from the current frame and from noise frames are used to compute voice metrics.

A voice metric is a measurement of the overall voice like characteristics of the signal energy. Depending on the values of these voice metrics, the flags' values are determined which then determine the state of the VAD. Updates to the noise spectral estimate are made only when the VAD is in the Silence state.

Furthermore, when the present invention is placed in a telephone network, the reverse link speech may introduce echo if there is a 2/4-wire hybrid in the speech path. In addition, end devices such as speakerphones could also introduce acoustic echoes. Many times the echo source is of sufficiently low level as not to be detected by the forward link VAD. As a result, the noise model is corrupted by the non-stationary speech signal causing artifacts in the processed speech. To prevent this from happening, the VAD information on the reverse link is also used to control when updates to the noise spectral estimates are made. Thus, the noise spectral estimate is only updated when there is silence on both sides of the conversation.

The second aspect of the present invention pertains to providing a method of determining the power spectral estimates based upon the existence or non-existence of speech in the current frame. The frequency spectrum components are altered differently depending on the state of the VAD. If the VAD state is in the Silence state, then frequency spectrum components are filtered using a broad smoothing filter. This help reduce the peaks in the noise spectrum caused by the random nature of the noise. On the other hand, if the VAD State is the Speech state, then one does not wish to smooth the peaks in the spectrum because these represent voice characteristics and not random fluctuations. In this case, the frequency spectrum components are filtered using a narrow smoothing filter.

One implementation of the present invention includes utilizing different types of smoothing or filtering for different signal characteristics (i.e., speech and noise) when using an FFT-based estimation of the power spectrum of the signal. Specifically, the present invention utilizes at least two windows having different sizes for a Wiener filter based on the likelihood of the existence of speech in the current frame of the noise-corrupted signal. The Wiener filter uses a wider window having a larger size (e.g., 45) when a voice activity detector (VAD) decides that speech does not exist in the current frame of the inputted speech signal. This reduces the peaks in the noise spectrum caused by the random nature of the noise. On the other hand, the Wiener filter uses a narrower window having a smaller size (e.g., 9) when the VAD decides that speech exists in the current frame. This retains the necessary speech information (i.e., peaks in the original speech spectrum) unchanged, thereby enhancing the intelligibility.

This implementation of the present invention reduces variance of the noise-corrupted signal when only noise exists, thereby reducing the noise level, while it keeps variance of the noise-corrupted signal when speech exists, thereby avoiding muffling of the speech.

Another implementation of the present invention includes smoothing coefficients used for the Wiener filter before the filter performs filtering. Smoothing coefficients are applicable to any form of digital filters, such as a Wiener filter. This second implementation keeps the processed speech clear and natural, and also avoids the musical noise.

These two implementations of the invention contribute to removing noise from speech signals without causing annoying artifacts such as "musical noise," and keeping the fidelity of the original speech high.

The third aspect of the present invention provides a method of processing the gain modification values so as to reduce musical noise effects at much higher levels of noise suppression. Random time-varying spikes and nulls in the computed gain modification values cause musical noise. To remove these unwanted artifacts a smoothing filter also filters the gain modification values.

The fourth aspect of the present invention provides a method of processing the gain modification values to adapt quickly to non-stationary narrow-band noise such as that found inside the compartment of a car. As other cars pass, the assumption of a stationary noise source breaks down and the passing car noise causes annoying artifacts in the processed signal. To prevent these artifacts from occurring the computed gain modification values are altered when noises such as passing cars are detected.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF A PREFERRED EMBODIMENT

A preferred embodiment of a method and apparatus for enhancing noise-corrupted speech according to the present invention will now be described in detail with reference to the drawings, wherein like elements are referred to with like reference labels throughout.

In the following description, for purpose of explanation, specific details are set forth in order to provide a thorough understanding of the present invention. It will be evident, however, to one skilled in the art that the present invention may be practiced without these specific details. In other instances, well-known structures and devices are shown in block diagram form in order to avoid unnecessarily obscuring the present invention.

Figure 1:
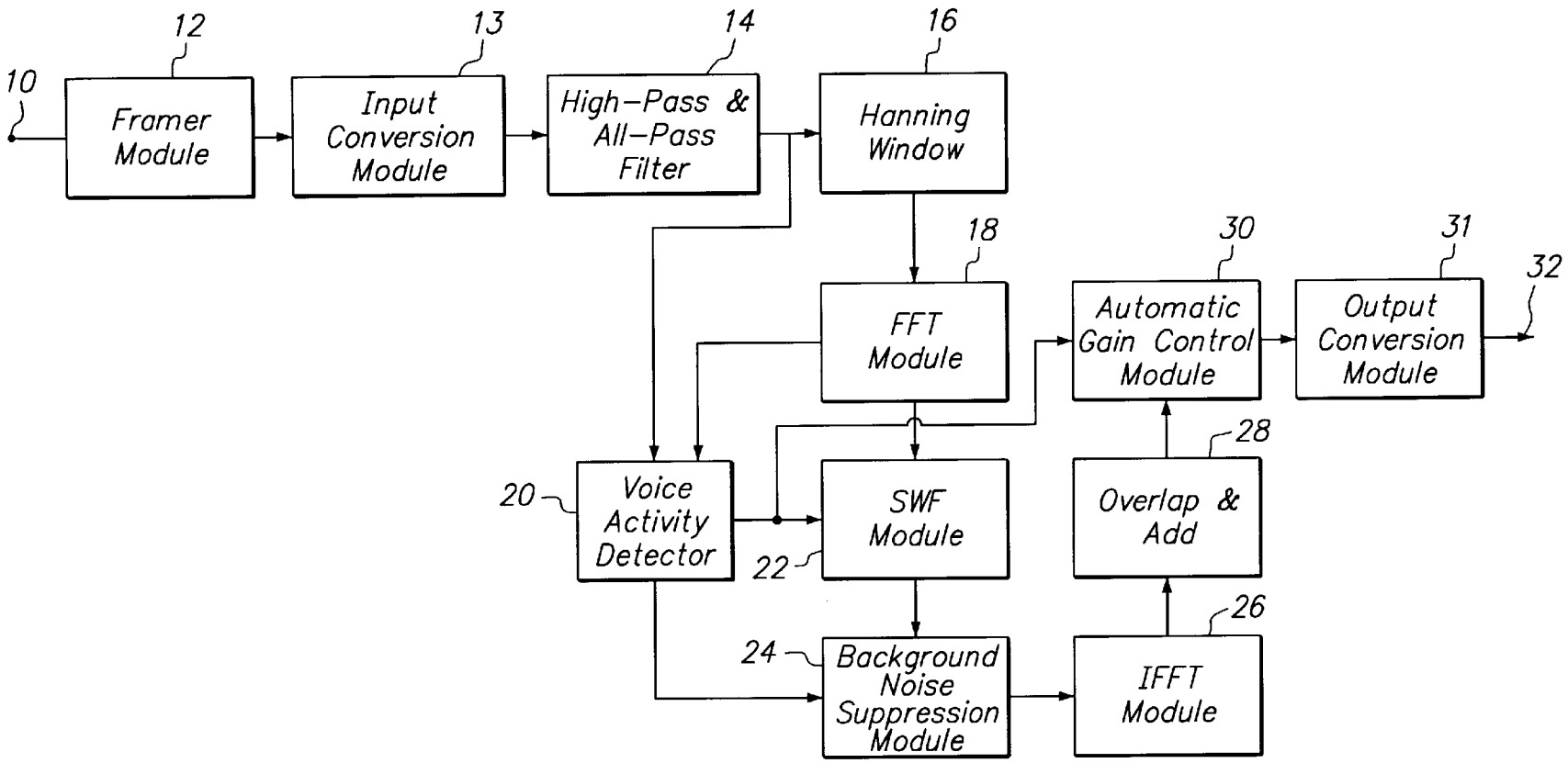
FIG. 1 is a block diagram of an embodiment of an apparatus for enhancing noise-corrupted speech according to the present invention.

FIG. 1 shows a block diagram of an example of an apparatus for enhancing noise-corrupted speech according to the present invention. The illustrative embodiment of the present invention is implemented, for example, by using a digital signal processor (DSP), e.g., a DSP designated by "DSP56303" manufactured by Motorola, Inc. The DSP processes voice data from a T1 formatted telephone line. The exemplary system uses approximately 11,000 bytes of program memory and approximately 20,000 bytes of data memory. Thus, the system can be implemented by commercially available DSPs, RISC (Reduced Instruction Set Computer) processors, or microprocessors for IBM-compatible personal computers.

It will be understood by those skilled in the art that each function block illustrated in FIGS. 1–5 can be implemented by any of hard-wired logic circuitry, programmable logic circuitry, a software program, or a combination thereof.

An input signal 10 is generated by sampling a speech signal at, for example, a sampling rate of 8 kHz. The speech signal is typically a "noise-corrupted signal." Here, the "noise-corrupted" signal contains a desirable speech component (hereinafter, "speech") and a undesirable noise component (hereinafter, "noise"). The noise component is cumulatively added to the speech component while the speech signal is transmitted.

A framer module 12 receives the input signal 10, and generates a series of data frames, each of which contains 80 samples of the input signal 10. Thus, each data frame (hereinafter, "frame") contains data representing a speech signal in a time period of 10.0 ms. The framer module 12 outputs the data frames to an input conversion module 13.

The input conversion module 13 receives the data frames from the framer module 12; converts a mu-law format of the samples in the data frames into a linear PCM format; and then outputs to a high-pass and all-pass filter 14.

The high-pass and all-pass filter 14 receives data frames in PCM format, and filters the received data. Specifically, the high-pass and all-pass filter 14 removes the DC component, and also alters the minimum phase aspect of the speech signal. The high-pass and all-pass filter 14 may be implemented as, for example, a cascade of Infinite Impulse Response (IIR) digital filters. However, filters used in this embodiment, including the high-pass and all-pass filter 14, are not limited to the cascade form, and other forms, such as a direct form, a parallel form, or a lattice form, could be used.

Typically, the high-pass filter functionality of the high-pass and all-pass filter 14 has a response expressed by the following relation $$H(z) = \frac{1 - z^{-1}}{1 - \frac{255}{256} z^{-1}} \quad [1]$$

and the all-pass filter functionality of the high-pass and all-pass filter 14 has a response expressed by the following relation $$H(z) = \frac{0.81 - 1.7119z^{-1} + z^{-2}}{1 - 1.7119z^{-1} + 0.81z^{-2}} \quad [2]$$

The high-pass and all-pass filter 14 filters 80 samples of a current frame, and appends the filtered 80 samples in the current frame with the previous 80 samples which have been filtered in an immediately previous frame. Thus, the high-pass and all-pass filter 14 produces and outputs extended frames each of which contains 160 samples.

Hanning window 16 multiplies the extended frames received from the high-pass and all-pass filter 14 based on the following expression $$w(n) = \frac{1}{2}\left[1 - \cos\left(\frac{2\pi n}{N-1}\right)\right], \text{ for } n = 0, 1, \ldots, 79 \quad [3]$$

Hanning window 16 alleviates problems arising from discontinuities of the signal at the beginning and ending edges of a 160-sample frame. The Hanning window 16 appends the time-windowed 160 sample points with 480 zero samples in order to produce a 640-point frame, and then outputs the 640-point frame to a fast Fourier transform (FFT) module 18.

While a preferred embodiment of the present invention utilizes Hanning window 16, other windows, such as a Bartlett (triangular) window, a Blackman window, a Hamming window, a Kaiser window, a Lanczos window, a Tukey window, could be used instead of the Hanning window 16.

The FFT module 18 receives the 640-point frames outputted from the Hanning window 16, and produces 321 sets of a magnitude component and a phase component of frequency spectrum, corresponding to each of the 640-point frames. Each set of a magnitude component and a phase component corresponds to a frequency in the entire frequency spectrum. Instead of the FFT, other transforming schemes which convert time-domain data to frequency-domain data can be used.

A voice activity detector (VAD) 20 receives the 80-sample filtered frames from the high-pass and all-pass filter 14, and the 321 magnitude components of the speech signal from the FFT module 18. In general, a VAD detects the presence of speech component in noise-corrupted signal. The VAD 20 in the present invention discriminates between speech and noise by measuring the energy and frequency content of the current data frame of samples.

The VAD 20 classifies a frame of samples as potentially including speech if the VAD 20 detects significant changes in either the energy or the frequency content as compared with the current noise model. The VAD 20 in the present invention categorizes the current data frame of the speech signal into four states: "Silence," "Primary Detect," "Speech," and "Hangover" (hereinafter, "speech state"). The VAD 20 of the preferred embodiment performs the speech/noise classification by utilizing a state machine as now will be described in detail referring to FIG. 2.

Figure 2:
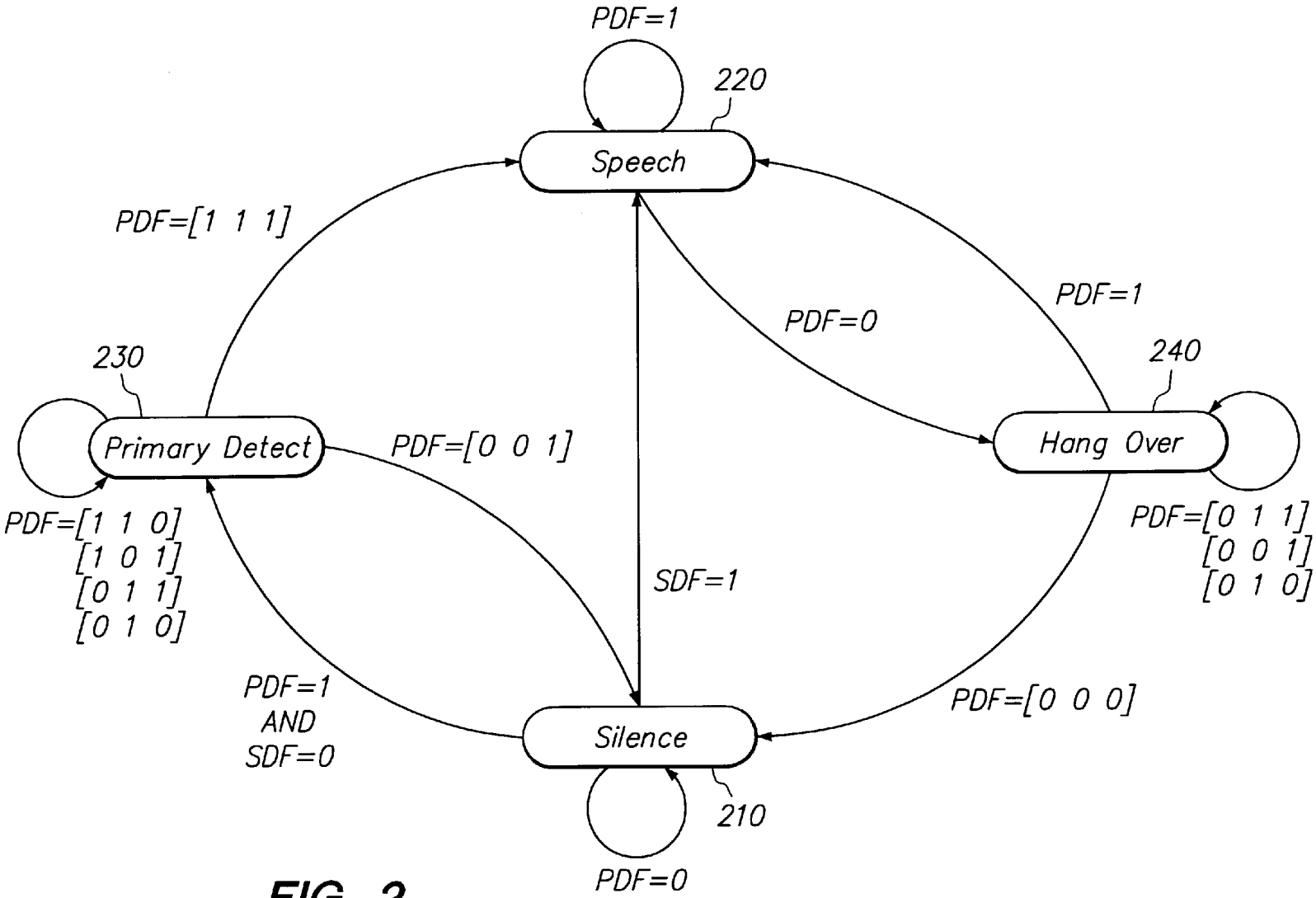
FIG. 2 is a state transition diagram for a voice activity detector according to the invention.

FIG. 2 shows a state transition diagram which the VAD 20 utilizes. The VAD 20 utilizes flags PDF and SDF in order to define state transitions thereof. The VAD 20 sets the flag PDF, indicating the state of the primary detection of the speech, to "1" when the VAD 20 detects a speech-like signal, and otherwise sets that flag to "0." The VAD 20 sets the flag SDF to "1" when the VAD detects a signal with high likelihood, and otherwise sets that flag to "0." The VAD 20 updates the noise spectral estimates only when the current speech state is the Silence state. The detailed description regarding setting criteria for the flags PDF and SDF will be set forth later, referring to FIG. 3.

First, locating the front end-point of a speech utterance will be described below. The VAD 20 categorizes the current frame into a Silence state 210 when the energy of the input signal is very low, or is simply regarded as noise. A transition from the Silence state 210 to a Speech state 220 occurs only when SDF="1," indicating the existence of speech in the input signal. When PDF="1" and SDF="0," a state transition from the Silence state 210 to a Primary Detect state 230 occurs. As long as PDF="0," a state transition does not occur, i.e., the state remains in the Silence state 210.

In a Primary Detect state 230, the VAD 20 determines that speech exists in the input signal when PDF="1" for three consecutive frames. This deferred state transition from the Primary Detect state 230 to the Speech state 220 prevents erroneous discrimination between speech and noise.

The history of consecutive PDF flags is represented in brackets, as shown in FIG. 2. In the expression "PDF=[f2 f1 f0]," the flag f2 corresponds to the most recent frame, and the flag f0 corresponds to the oldest frame, where flags f0–f2 correspond to three consecutive data frames of the speech signal. For example, the expression "PDF=[1 1 1]" indicates the PDF flag has been set for the last three frames.

When in Primary Detect state 230, unless two consecutive flags are equal to "0," a state transition does not occur, i.e., the state remains in the Primary Detect state 230. If two consecutive flags are equal to "0," then a state transition from the Primary Detect state 230 to the Silence state 210 occurs. Specifically, the PDF flags of [0 0 1] trigger a state transition from the Primary Detect state 230 to the Silence state 210. The PDF flags of [1 1 00], [1 0], [0 1 1], and [0 1 0] cause looping back to the Primary Detect state 230.

Next, a transition from the Speech state 220 to the Silence state 210 at the conclusion of a speech utterance will be described below. The VAD 20 remains in the Speech state 220 as long as PDF="1." A Hang Over state 240 is provided as an intermediate state between the Speech state 220 and the Silence state 210, thus avoiding an erroneous transition from the Speech state 220 to the Silence state 210, caused by an intermittent occurrence of PDF="0."

A transition from the Speech state 220 to the Hang Over state 240 occurs when PDF="0." A PDF of "1," when the VAD 20 is in the Hang Over state 240, triggers a transition from the Hang Over state 240 back to the Speech state 220. If three consecutive flags are equal to "0," or if PDF=[0 0 0], during the Hang Over state 240, then a transition from the Hang Over state 240 to the Silence state 210 occurs. Otherwise, the VAD 20 remains in the Hang Over state 240. Specifically, PDF flag sequences of [0 1 1], [0 0 1], and [0 1 0] cause looping back to the Hang Over state 240.

Figure 3:
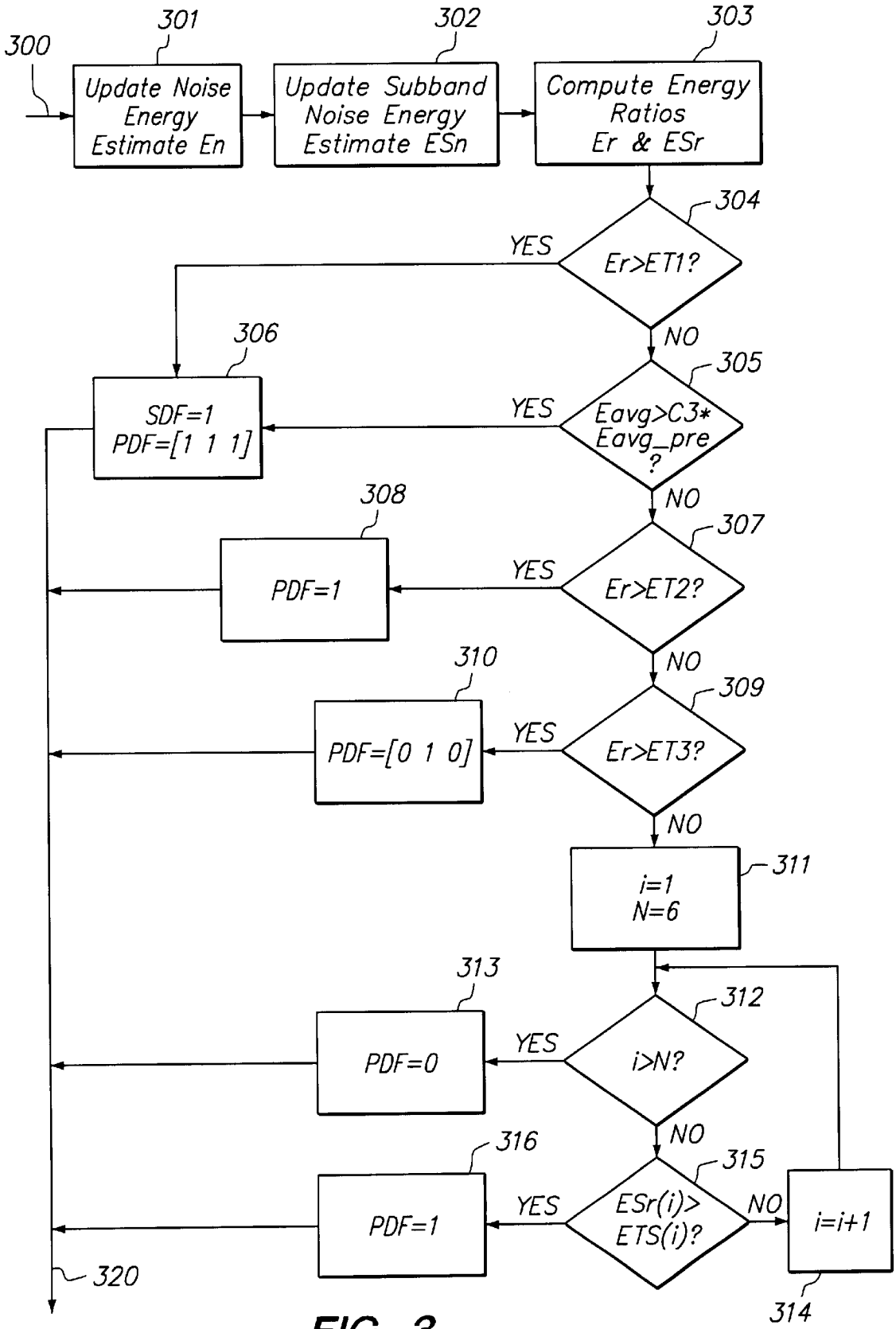
FIG. 3 is a flow chart which illustrates a process to determine the PDF and SDF flags for each frame of the input signal.

FIG. 3 is a flow chart of a process to determine the PDF and SDF flags for each data frame of the input signal. Referring to FIG. 3, at an input step 300, the VAD 20 begins the process by inputting an 80-sample frame of the filtered data in the time domain outputted from high-pass and all-pass filter 14, and the 321 magnitude components outputted from the FFT module 18.

At step 301, the VAD 20 computes estimated noise energy. First, the VAD 20 produces an average value of 80 samples in a data frame ("Eavg"). Then, the VAD 20 updates noise energy En based on the average energy Eavg and the following expression:

$$En = C1 * En + (1 - C1) * Eavg. \quad [4]$$

Here, the constant C1 can be one of two values depending on the relationship between Eavg and the previous value of En. For example, if Eavg is greater than En, then the VAD 20 sets C1 to be C1a. Otherwise, the VAD 20 sets C1 to be C1b. The constants C1a and C1b are chosen such that, during times of speech, the noise energy estimates are only increased slightly, while, during times of silence, the noise estimates will rapidly return to the correct value. This procedure is preferable because its implementation is not so complicated, and adaptive to various situations. The system of the embodiment is also robust in actual performance since it makes no assumption about the characteristics of either the speech or the noise which are contained in the speech signal.

The above procedure based on expression 4 is effective for distinguishing vowels and high SNR signals from background noise. However, this technique is not sufficient to detect an unvoiced or low SNR signal. Unlike noise, unvoiced sounds usually have high frequency components, and will be masked by strong noise having low frequency components.

At step 302, in order to detect these unvoiced sounds, the VAD 20 utilizes the 321 magnitude components from the FFT module 18 in order to compute estimated noise energy ESn (n=1, . . . , 6) in six different frequency subbands. The frequency subbands are determined by analyzing the spectrums of, for example, the 42 phonetic sounds that make up the English language. At step 302, the VAD 20 computes the estimated subband noise energy ESn for each subband, in a manner similar to that of the estimated noise energy En using the time domain data at step 301, except that the 321 magnitude components are used, and that the averages are only calculated over the magnitude components that fall within a corresponding subband range.

Next, at step 303, the VAD 20 computes integrated energy ratios Er and ESr for the time domain energies as well as the subband energies, based on the following expressions:

$$Er=C2*Er+(1-C2)Eavg/En \quad [5]$$

$$ESr(i)=C2*ESr(i)+(1-C2)*ESavg(i)/ESn(i),\ i=1,\ldots,6 \quad [6]$$

where the constant C2 has been determined empirically.

At step 304, the VAD 20 compares the time-domain energy ratio Er with a threshold value ET1. If the time-domain energy ratio Er is greater than the threshold ET1, then control proceeds to step 306. Otherwise control proceeds to step 305.

At step 306, the VAD 20 regards the input signal as containing "speech" because of the obvious existence of talk spurts with high energy, and sets the flags SDF and PDF to "1." Since the energy ratios Er and ESr are integrated over a period of time, the above discrimination of speech is not affected by a sudden talk spurt which does not last for a long time, such as those found in the voiced and unvoiced stops in American English (i.e., [p], [b], [t], [d], [k], [g]).

Even if the time-domain energy ratio Er is not greater than the threshold ET1, the VAD 20 determines, at step 305, whether there is a sudden and large increase in the current Eavg as compared to the previous Eavg (referred to as "Eavg_pre") computed during the immediately previous frame. Specifically, the VAD 20 sets the flags SDF and PDF to "1" at step 306 if the following relationship is satisfied at step 305.

$$Eavg>C3*Eavg_pre \quad [7]$$

Constant C3 is determined empirically. The decision made at step 305 enables accurate and quick detection of the existence of a sudden spurt in speech such as the plosive sounds.

If the energy ratio Er does not satisfy the two criteria checked at steps 304 and 305, then control proceeds to step 307. At step 307, the VAD 20 compares the energy ratio Er with a second threshold value ET2 that is smaller than ET1. If the energy ratio Er is greater than the threshold ET2, control proceeds to step 308. Otherwise, control proceeds to step 309. At step 308, the VAD 20 sets the flag PDF to "1," but retains the flag SDF unchanged.

If the energy ratio Er is not greater than the threshold ET2, then, at step 309, the VAD 20 compares energy ratio Er with a third threshold value ET3 that is smaller than ET2. If the energy ratio Er is greater than the threshold ET3, then control proceeds to step 310. Otherwise, control proceeds to step 311.

At step 310, the VAD 20 sets the history of the consecutive PDF flags such that a transition from the Primary Detect state 230 or the Hang Over state 240, to the Silence state 210 or Speech state 220 does not occur. For example, the PDF flag history is set to [0 1 0].

Finally, if the energy ratio Er is not greater than the threshold ET3, then, at step 315, the VAD 20 compares the subband ratios ESr(i ) (i=1, . . . , 6) with corresponding thresholds ETS(i) (i=1, . . . , 6). The VAD 20 performs this comparison repeatedly utilizing a counter value i, and a loop including steps 312, 314, and 315.

At step 315, if any of the subband energy ratios ESr(i) is greater than the corresponding threshold ETS(i) (i=1, . . . , 6), then control proceeds to step 316. At step 316, the VAD 20 sets the flag PDF to "1," and exits to 320. Otherwise, control proceeds to step 314 for another comparison with an incremented counter value i. If none of the subband energy ratios ESr(i) is greater than the threshold ETS(i), then control proceeds to step 313. At step 313, the VAD 20 sets the flag PDF to "0." At the end of the routine 320, the flags SDF and PDF are determined, and the VAD 20 exits from this routine.

Now, referring back to FIG. 1, the VAD 20 outputs one of integers 0, 1, 2, and 3 indicating the speech state of the current frame (hereinafter, "speech state"). The integers 0, 1, 2, and 3 designate the states of "Silence," "Primary Detect," "Speech," and "Hang Over," respectively.

A spectral smoothing module 22, which in the preferred embodiment is a smoothed Wiener filter (SWF), receives the speech state of the current frame outputted from the VAD 20, and the 321 magnitude components outputted from the FFT module 18. The SWF module 22 controls a size of a window with which a Wiener filter filters the noise-corrupted speech, based on the current speech state. Specifically, if the speech state is the Silence state, then the SWF module 22 convolves the 321 magnitude components by a triangular window having a window length of 45. Otherwise, the SWF module 22 convolves the 321 magnitude components by a triangular window having a window length of 9. The SWF module 22 passes the phase components from the FFT module 18 to a background noise suppression module 24 without modification.

If the current speech state is the Silence state, then a larger size (=45, in this embodiment) of the smoothing window enables the SWF module 22 to efficiently smooth out the spikes in the noise spectrum, which are most likely due to random variations. On the other hand, when the current state is not the Silence state, the large variance of the frequency spectrum is most probably caused by essential voice information, which should be preserved. Therefore, if the speech state is not the Silence state, then the SWF module 22 utilizes a smaller size (=9, in this embodiment) of the smoothing window. Preferably, a ratio of a length of a wide window to a length of a short window is equal to, or more than 5.

In another embodiment, the control signal outputted from the VAD 20 may represent more than two speech states based on a likelihood that speech exists in the noise-corrupted signal. Also, the VAD 20 may apply smoothing windows of more than two sizes to the noise-corrupted signal, based on the control signal representing a likelihood of the existence of speech.

For example, the signal from the VAD 20 may be a two-bit signal, where values "0," "1," "2," and "3" of the signal represent "0–25% likelihood of speech existence," "25–50% likelihood of speech existence," "50–75% likelihood of speech existence," and "75–100% likelihood of speech existence," respectively. In such a case, the VAD 20 switches filters having four different widths based on the likelihood of the speech existence. Preferably, the largest value of the window size is not less than 45, and the least value of the window size is not more than 8.

The VAD 20 may output a control signal representing more minutely categorized speech states, based on the likelihood of the speech existence, so that the size of the window is changed substantially continuously in accordance with the likelihood.

The SWF module 22 of the present invention utilizes smoothing filter coefficients of the Wiener filter before the SWF module 22 filters the noise-corrupted speech signal. This aspect of the present invention avoids nulls in the Wiener filter coefficients, thereby keeping the filtered speech clear and natural, and suppressing the musical noise artifacts. The SWF module 22 smooths the filter coefficients by averaging a plurality of consecutive coefficients, such that nulls in the filter coefficients are replaced by substantially non-zero coefficients.

Other mathematical relationships used for the SWF module 22 will be described in detail below. The SWF module 22 utilizes a spectral subtraction scheme. Spectral subtraction is a method for restoring the spectrum of speech in a signal corrupted by additive noise, by subtracting an estimate of the average noise spectrum from the noise-corrupted signal's spectrum. The noise spectrum is estimated, and updated based on a signal when only noise exists (i.e., speech does not exist). The assumption is that the noise is a stationary, or slowly varying process, and that the noise spectrum does not change significantly during updating intervals.

If the additive noise n(t) is stationary and uncorrelated with the clean speech signal s(t), then the noise-corrupted speech y(t) can be written as follows:

$$y(t)=s(t)+n(t) \quad [8]$$

The power spectrum of the noise-corrupted speech is the sum of the power spectra of s(t) and n(t). Therefore, $$P_Y(f)=P_S(f)+P_N(f) \quad [9]$$

The clean speech spectrum with no noise spectrum can be estimated by subtracting the noise spectrum from the noise-corrupted speech spectrum as follows:

$$\hat{P}_S(f)=P_Y(f)-P_N(f) \quad [10]$$

In an actual situation, this operation can be implemented on a frame-by-frame basis to the input signal using a FFT algorithm to estimate the power spectrum. After the clean speech spectrum is estimated by spectral subtraction, the clean speech signal in the time domain is generated by an inverse FFT from the magnitude components of subtracted spectrum, and the phase components of the original signal.

The spectral subtraction method substantially reduces the noise level of the noise-corrupted input speech, but it can introduce annoying distortion of the original signal. This distortion is due to fluctuation of tonal noises in the output signal. As a result, the processed speech may sound worse than the original noise-corrupted speech, and can be unacceptable to listeners.

The musical noise problem is best understood by interpreting spectral subtraction as a time varying linear filter. First, the spectral subtraction equation is rewritten as follows:

$$\hat{S}(f)=H(f)Y(f) \quad [11]$$

$$H(f)=\sqrt{\frac{P_Y(f)-P_N(f)}{P_Y(f)}} \quad [12]$$

$$\hat{s}(t)=F^{-1}\{\hat{S}(f)\} \quad [13]$$

where Y (f) is a Fourier transform of noise-corrupted speech, H(f) is a time varying linear filter, and S(f) is an estimate of the Fourier transform of clean speech. Therefore, spectral subtraction consists of applying a frequency dependent attenuation to each frequency in the noise-corrupted speech power spectrum, where the attenuation varies with the ratio of $P_N(f)/P_Y(f)$.

Since the frequency response of the filter H(f) varies with each frame of the noise-corrupted speech signal, it is a time varying linear filter. It can be seen from the equation above that the attenuation varies rapidly with the ratio $P_N(f)/P_Y(f)$ at a given frequency, especially when the signal and noise are nearly equal in power. When the input signal contains only noise, musical noise is generated because the ratio $P_N(f)/P_Y(f)$ at each frequency fluctuates due to measurement error, producing attenuation filters with random variation across frequencies and over time.

A modification to spectral subtraction is expressed as follows:

$$H(f)=\sqrt{\frac{P_Y(f)-\delta(f)P_N(f)}{P_Y(f)}} \quad [14]$$

where δ(f) is a frequency dependent function. When δ(f) is greater than 1, the spectral subtraction scheme is referred to as "over subtraction."

The present invention utilizes smoothing of the Wiener filter coefficients, instead of the over subtraction scheme. The SWF module 22 computes an optimal set of Wiener filter coefficients H(f) based on an estimated power spectral density (PSD) of the clean speech and an estimated PSD of the noise, and outputs the filtered spectrum information S(f) in the frequency domain which is equal to H(f)X(f). The power spectral estimate of the current frame is computed using a standard periodogram estimate:

$$\hat{P}(f)=1/N|X(f)|^2 \quad [15]$$

where P(f) is the estimate of the PSD, and X(f) is the FFT-processed signal of the current frame.

If the current frame is classified as noise, then the PSD estimate is smoothed by convolving it with a larger window to reduce the short-term variations due to the noise spectrum. However, if the current frame is classified as speech, then the PSD estimate is smoothed with a smaller window. The reason for the smaller window for non-noise frames is to keep the fine structure of the speech spectrum, thereby avoiding muffling of speech. The noise PSD is estimated when the speech does not exist by averaging over several frames in accordance with the following relationship:

$$\hat{P}_N(f)=\rho\hat{P}_N(f)+\gamma(1-\rho)P_Y(f) \quad [16]$$

where $P_Y(f)$ is the PSD estimate for the current frame. The factor γ is used as an over subtraction technique to decrease the level of noise and reduce the amount of variation in the Wiener filter coefficients which can be attributed to some of the artifacts associated with spectral subtraction techniques. The amount of averaging is controlled with the parameter ρ.

To determine the optimal Wiener filter coefficients, the PSD of the speech only signal, $P_S$, is needed. However, this is generally not available. Thus, an estimate of the speech only signal $P_S$ is obtained by the following relationship:

$$\hat{P}_S = P_Y - \delta\hat{P}_N \quad [17]$$

where different values of δ can be used based on the state of the speech signal. The factor δ is used to reduce the amount of over subtraction used in the estimate of the noise PSD. This will reduce muffling of speech.

Once the PSD estimates of both the noise and speech are computed, the Wiener filter coefficients are computed as:

$$H(f) = \max\left(\frac{\hat{P}_S}{\hat{P}_S + \delta\hat{P}_N}, H_{\mathrm{MIN}}\right) \quad [18]$$

where $H_{MIN}$ is used to set the maximum amount of noise reduction possible. Once H(f) is determined, it is filtered to reduce the sharp time varying nulls associated with the Wiener filter coefficients. These filtered filter coefficients are then used to filter the frequency domain data S(f)=H(f)X(f).

Again referring to FIG. 1, the background noise suppression module 24 receives the state of the speech signal from the VAD 20, and the 321 smoothed magnitude components as well as the raw phase components both from the SWF module 22. The background noise suppression module 24 calculates gain modification values based on the smoothed frequency components and the current state of the speech signal outputted from the VAD 20. The background noise suppression module 24 generates a noise-reduced spectrum of the speech signal based on the raw magnitude components, and the original phase components both outputted from the FFT module 18.

Figure 4:
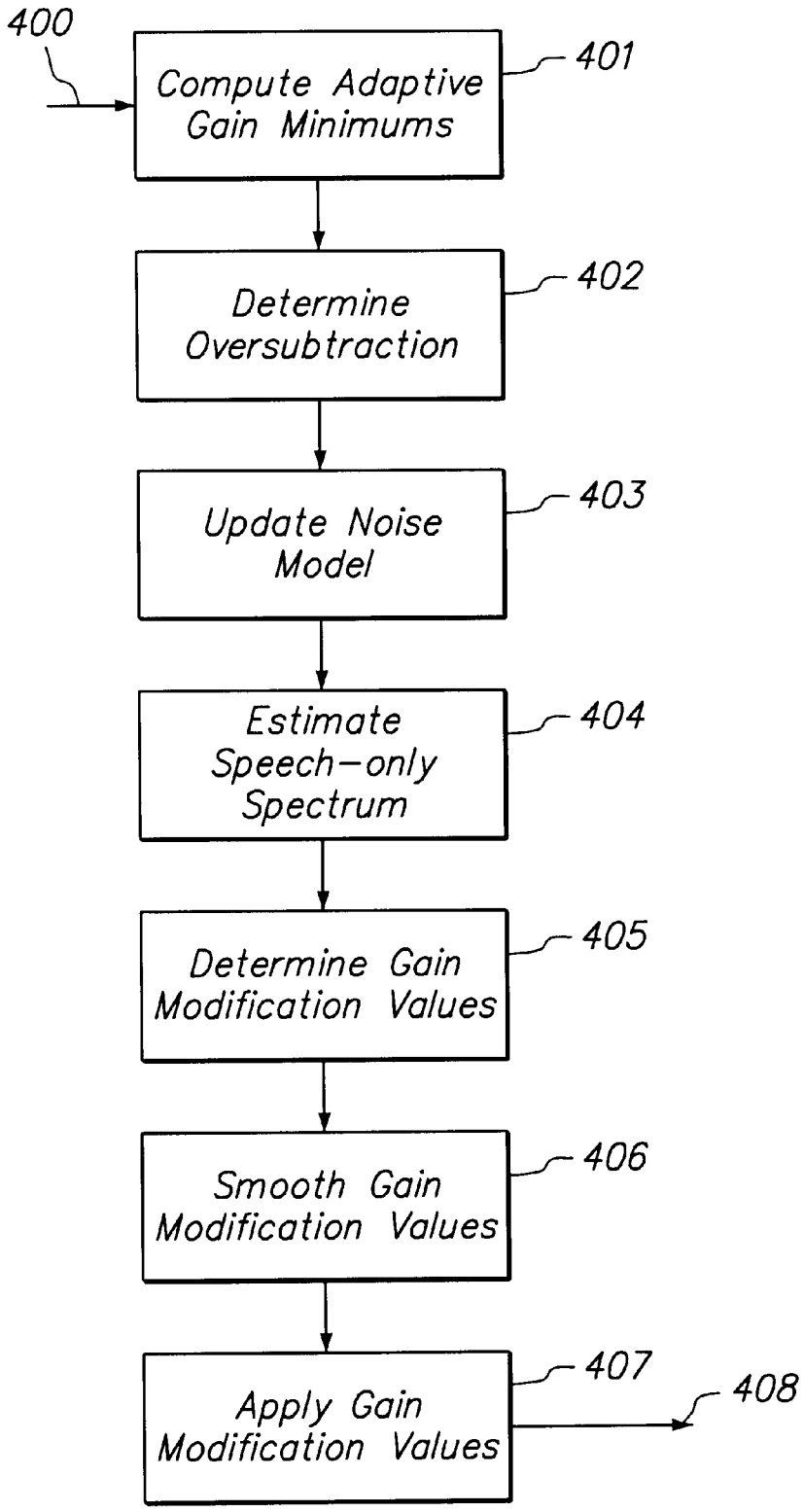
FIG. 4 is a flow chart of a sequence of operation for a background noise suppression module of the invention.

FIG. 4 is a flow chart which the background noise suppression module 24 utilizes. The steps shown in FIG. 4 will be described in detail below.

First, as input data 400, the background noise suppression module 24 receives necessary data and values from the VAD 20, and the SWF module 22. At step 401, the background noise suppression module 24 computes the adaptive minimum value for the gain modification GAmin for each of the six subbands by comparing the current energy in each subband to the estimate of the noise energy in each subband. These six subbands are the same as those used in relation to computation of noise ratio ESr above.

If the current energy is greater than the estimated noise energy, the minimum value GAmin is computed using the following relationship:

$$GA\ \min(i) = G\ \min + \left(B1\left(Eavg - \frac{En}{Eavg}\right) + B2\left(ESavg(i) - \frac{ESn(i)}{ESavg(i)}\right)\right),\ i = 1, \ldots, 6, \quad [19]$$

where

Gmin is a value computed from the maximum amount of noise attenuation desired;

B1, B2 are empirically determined constants;

Eavg is the average value of the 80-sample filtered frame;

En is the estimate of the noise energy;

ESavg(i) is the average value in subband i computed from the magnitude components in subband i; and ESn(i) is the estimate of the noise energy in subband i. The VAD 20 calculates all of these values for the current frame of speech signal before the frame data reaches the background noise suppression module 24, and the background noise suppression module 24 reuses the values.

If the current energy in the subband is less than the estimated noise energy in the corresponding subband, then GAmin(i) is set to the minimum value desired Gmin. To prevent these values from changing too fast, and causing artifacts in the speech, they are integrated with past values using the following relationship:

$$G\ \min(i) = B3 * G\ \min(i) + (1 - B3) * GA\ \min(i),\ i = 1, \ldots, 6 \quad [20]$$

where B3 is an empirically determined constant. This procedure allows shaping of the spectrum of the residual noise so that its perception can be minimized. This is accomplished by making the spectrum of the residual noise similar to that of the speech signal in the given frame. Thus, more noise can be tolerated to accompany high-energy frequency components of the clean signal, while less noise is permitted to accompany low-energy frequency components.

As previously discussed, the method of over-subtraction provides protection from musical noise artifacts associated with spectral subtraction techniques. The present invention improved spectral over-subtraction method as described in detail below. At step 402, the background noise suppression module 24 computes the amount of over-subtraction. The amount of over-subtraction is nominally set at 2. If, however, the average energy Eavg computed from the filtered 80-sample frame is greater than the estimate of the noise energy En, then the amount of over-subtraction is reduced by an amount proportional to (Eavg−En)/Eavg.

Next, at step 403, the background noise suppression module 24 updates the estimate of the noise power spectral density. If the speech state outputted from the VAD 20 is the Silence state, and, when available, a voice activity detector at the other end of the communication channel also outputs a signal representing that a speech state at the other end is the Silence state, then the 321 smoothed magnitude components are integrated with the previous estimate of the noise power spectral density at each frequency based on the following relationship:

$$Pn(i) = D * Pn(i) + (1 - D) * P(i),\ i = 1, \ldots, 321 \quad [21]$$

where Pn(i) is the estimate of the noise power spectrum at frequency i; and P(i) is the current smoothed frequency i, computed at the SWF module 22 of FIG. 1.

When the present invention is applied to a telephone network, the reverse link speech can introduce echo if there is a 2/4-wire hybrid in the speech path. In addition, end devices, such as speakerphones, can also introduce acoustic echoes. The echo source is often sufficiently low level, and thus is not detected by a forward link of the VAD 20. As a result, the noise model is corrupted by the non-stationary speech signal causing artifacts in the processed speech. In order to avoid the adverse effects caused by echoing, the VAD 20 may also utilize information on a reverse link in order to update the noise spectral estimates. In that case, the noise spectral estimates are updated only when there is silence on both sides of the conversation.

In order to calculate the gain modification values, the power spectral density of the speech-only signal is needed. Since the background noise is always present, this information is not directly available from the noise-corrupted speech signal. Therefore, the background noise suppression module 24 estimates the power spectral density of the speech-only signal at step 404.

The background noise suppression module 24 estimates the speech-only power spectral density Ps by subtracting the noise power spectral density estimate computed in step 403 from the current speech-plus-noise power spectral density P at each of six frequency subbands. The speech-only power spectral density Ps is estimated based on the 321 smoothed magnitude components. Before the subtraction is performed, the noise power spectral density estimate is first multiplied by the over-subtraction value computed at step 402.

At step 405, the background noise suppression module 24 determines gain modification values based on the estimated speech-only (i.e., noise-free) power spectral density P.

Then, at step 406, the background noise suppression module 24 smooths the gain values for the six frequency subbands by convolving the gain values with a 32-point triangular window. This convolution fills the nulls, softens the spikes in the gain values, and smooths the transition regions between subbands (i.e., edges of each subbands). All of the functionality of the convolution at step 406 reduces musical noise artifacts.

Finally, at step 407, the background noise suppression module 24 applies the smoothed gain modification values to the raw magnitude components of the speech signal, and combines the raw magnitude components with the original phase components in order to output a noise reduced FFT frame having 640 samples. This resulting FFT frame is an output signal 408.

Referring back to FIG. 1, an inverse FFT (IFFT) module 26 receives the magnitude modified FFT frame, and converts the FFT frame in the frequency domain to a noise-suppressed extended frame in the time domain having 640 samples.

An overlap and add module 28 receives the extended frame in the time domain from the IFFT module 26, and add two values from adjacent frames in time axis in order to prevent the magnitude of the output from decreasing at the beginning edge and the ending edge of each frame in the time domain. The overlap and add module 28 is necessary because the Hanning Window 16 performs pre-windowing onto the inputted frame.

Specifically, the overlap and add module 28 adds each value of the first to the $80^{th}$ samples of the present 640-sample frame and each value of the $81^{st}$ to the $160^{th}$ samples of the immediately previous 640-sample frame in order to produce a frame in the time domain having 80 samples as an output of the module. For example, the overlap and add module 28 adds the first sample of the present 640-sample frame and the $81^{st}$ sample of the immediately previous 640-sample frame; adds the second sample of the present 640-sample frame and the $82^{nd}$ sample of the immediately previous 640-sample frame; and so on. The overlap and add module 28 stores the present 640-sample frame in a memory (not shown) in order to use it for generating the next frame's overlap-and-add operation.

An automatic gain control (AGC) module 30 compensates the loudness of the noise-suppressed speech signal outputted from the overlap and add module 28. This is necessary since spectral subtraction described above actually removes noise energy from the original speech signal, and thus reduces the overall loudness of the original signal. In order to keep the peak level of an output signal 32 at a desirable magnitude, and to keep the overall speech loudness constant, the AGC module 30 amplifies the noise-suppressed 80-sample frame outputted from the overlap and add module 28, and adjusts amplifying gain based on a scheme as will be described below. The AGC module 30 outputs gain-controlled 80-sample frames as the output signal 32.

Figure 5:
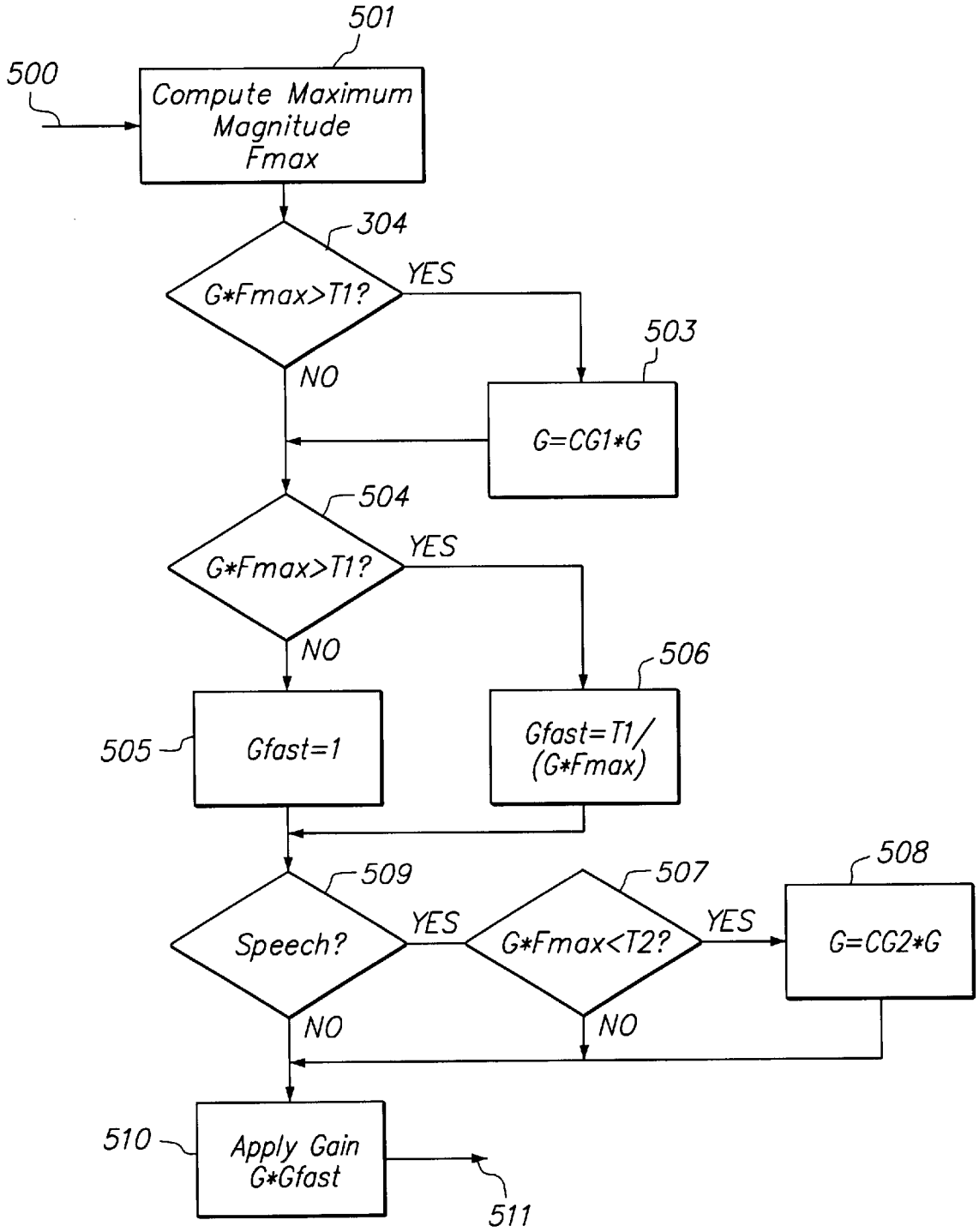
FIG. 5 is a flow chart of a sequence of operation for an automatic gain control module used in the invention.

FIG. 5 shows a flow chart of the process which the AGC module 30 utilizes. First, the AGC module 30 receives the noise-suppressed speech signal 500 which contains 80-sample frames. At step 501, the AGC module finds a maximum magnitude Fmax within a frame. Then, at step 502, the AGC multiplies the maximum magnitude Fmax by a previous gain G which is used for the immediately previous frame, and compares the product of the gain G and the maximum magnitude Fmax (i.e., G*Fmax) with a threshold T1.

If the value (G*Fmax) is greater than the threshold T1, then, at step 503, the AGC module 30 replaces the gain G by a reduced gain (CG1*G) wherein a constant CG1 is empirically determined. Otherwise, control proceeds to step 504.

At step 504, the AGC module 30 again multiplies the maximum magnitude Fmax by the previous gain G, and compares the value (G*Fmax) with the threshold T1. If the value (G*Fmax) is still greater than the threshold T1, then, at step 506, the AGC module 30 computes a secondary gain Gfast based on the following relationship:

$$Gfast = T1/(G*Fmax) \quad [22]$$

Otherwise, control proceeds to step 505, and the AGC module 30 sets the secondary gain Gfast to 1.

Next, at step 509, if the current state represented by the output signal from the VAD 20 is the Speech state, which indicates the presence of speech, then control proceeds to step 507. Otherwise, control proceeds to step 510. At step 507, the AGC module 30 multiplies the maximum magnitude Fmax by the previous gain G, and compares the value (G*Fmax) with a threshold T2. If the value (G*Fmax) is less than the threshold T2, then, at step 508, the AGC module 30 replaces the gain G by a increased gain (CG 2*G) wherein a constant CG2 is empirically determined. Otherwise, control proceeds to step 510.

Finally, at step 510, the AGC module 30 multiplies each sample in the current frame by a value (G*Gfast), and then outputs the gain-controlled speech signal as an output 511. The AGC module 30 stores a current value of the gain G for applying it to the next frame of samples.

Referring back to FIG. 1, an output conversion module 31 receives the gain controlled signal from the AGC module 30, converts the signal in the linear PCM format to a signal in the mu-law format, and outputs the converted signal to the T1 telephone line.

The above-described embodiment of the present invention has been tested both with actual live voice data, as well as data generated by an external testing equipment, such as the T-BERD 224 PCM Analyzer. The test results showed that the system according to the present invention improves the SNR by 18 dB while keeping artifacts to a minimum.

The present invention can be modified to utilize different types of spectral smoothing or filtering scheme, for different speech sound. The present invention also can be modified to incorporate different types of Wiener filter coefficient smoothing, or filtering, for different speech sound or for applying equalization such as a bass boost to increase the voice quality. The present invention is applicable to any type of generalized Wiener filters which encompass magnitude subtraction or spectral subtraction. For example, noise reduction techniques using an LPC model can be used for the present invention in order to estimate the PSD of the noise, instead of using an FFT-processed signal.

The present invention has applications, such as a voice enhancement system for cellular networks, or a voice enhancement system to improve ground to air communications for any type of plane or space vehicle. The present invention can be applied to literally any situation where communications is performed in a noisy environment, such as in an airplane, a battlefield, or a car. A prototype of the present invention has already been manufactured for testing in cellular networks.

The first aspect of the present invention, changing a window size based on a speech state, and the second aspect of the present invention, smoothing filter coefficients, are preferably utilized together. However, one of the first aspect and the second aspect may be separately implemented to achieve the present invention's objects.

Other modifications and variations to the present invention will be apparent to those skilled in the art from the foregoing disclosure and teachings. The applicability of the invention is not limited to the manner in which the noise-corrupted signal is obtained. Thus, while only certain embodiments of the invention have been specifically described herein, it will be apparent that numerous modifications may be made thereto without departing from the spirit and scope of the invention.

What is claimed is:

1. A noise suppression device for suppressing noise in a noise-corrupted signal, said device comprising:

a voice activity detector which receives said noise-corrupted signal, and generates a control signal in accordance with a likelihood of existence of speech in said noise-corrupted signal, wherein said voice activity detector includes a state machine; wherein said state machine has an intermediate state between a silence state where said speech is determined not to exist in said noise-corrupted signal, and a speech state where said speech is determined to exist in said noise-corrupted signal, wherein said state machine has a primary detect flag, and a speech detect flag; and said voice activity detector sets said primary detect flag and said speech detect flag, so that a state transition directly from said silence state to said speech state occurs, if an energy ratio of said speech is larger than a first threshold; and wherein said voice activity detector sets said primary detect flag and said speech detect flag, so that a state transition from said silence state to said speech state via said intermediate state occurs, if an energy ratio of said speech is larger than a second threshold; and a smoothing module which filters said noise-corrupted signal based on a window whose size is determined based on said control signal, wherein said size of said window has at least two values in accordance with said likelihood that said speech exists in said noise-corrupted signal, wherein the largest value of said at least two values is provided when said speech is determined not to exist in said noise-corrupted signal, and wherein the smallest value of said at least two values is provided when said speech is determined to exist in said noise-corrupted signal;

wherein said smoothing module further comprises a Wiener filter; and wherein nulls of filter coefficients of said Wiener filter are removed.

2. A noise suppression device as claimed in claim 1, wherein a ratio of said largest value to said smallest value is at least 5.

3. A noise suppression device as claimed in claim 2, wherein said largest value is not less than 45, and said smallest value is not more than 8.

4. A noise suppression device as claimed in claim 1, wherein said voice activity detector sets said primary detect flag and said speech detect flag, so that a state transition from said intermediate state does not occur, if an energy ratio of said speech is larger than a third threshold.

5. A noise suppression device as claimed in claim 1, further comprising a background noise suppression module, wherein said background noise suppression module compares a speech energy with an estimated noise energy;

determines a gain value based on said comparison of said speech energy and said estimated noise energy;

smooths said gain value; and suppresses background noise in said noise-corrupted signal using said smoothed gain value.

6. A noise suppression device as claimed in claim 1, further comprising an automatic gain control module, wherein said automatic gain control module computes a maximum magnitude of said noise-corrupted signal;

compares a product of a gain and said maximum magnitude, with a first threshold; and reduces said gain if said product is larger than said first threshold.

7. A noise suppression device as claimed in claim 6, wherein said automatic gain control module compares a product of said gain and said maximum magnitude, with a second threshold; and increases said gain if said product is smaller than said second threshold.

8. A method for suppressing noise in a noise-corrupted signal, comprising the steps of:

receiving said noise-corrupted signal;

generating a control signal in accordance with a likelihood of existence of speech in said noise-corrupted signal, wherein said control signal is generated based on a state machine; and said state machine has an intermediate state between a silence state where said speech is determined not to exist in said noise-corrupted signal, and a speech state where said speech is determined to exist in said noise-corrupted signal, wherein said state machine has a primary detect flag, and a speech detect flag; and wherein said voice activity detector sets said primary detect flag and said speech detect flag, so that a state transition directly from said silence state to said speech state occurs, if an energy ratio of said speech is larger than a first threshold;

determining a size of a window based on said control signal, wherein said size of said window has at least two values in accordance with said likelihood that said speech exists in said noise-corrupted signal, wherein the largest value of said at least two values is provided when said speech is determined not to exist in said noise-corrupted signal, and wherein the smallest value of said least two values is provided when said speech is determined to exist in said noise-corrupted signal; and filtering said noise-corrupted signal based on said window;

wherein said filtering step further comprises a step of applying a Wiener filter to said noise-corrupted signal; and wherein nulls of filter coefficients of said Wiener filter are removed.

9. A method for suppressing noise as claimed in claim 8, wherein a ratio of said largest value to said smallest value is at least 5.

10. A method for suppressing noise as claimed in claim 9, wherein said largest value is not less than 45, and said smallest value is not more than 8.

11. A method for suppressing noise as claimed in claim 8, wherein said primary detect flag and said speech detect flag are set, so that a state transition from said silence state to said speech state via said intermediate state occurs, if an energy ratio f said speech is larger than a second threshold.

12. A method for suppressing noise as claimed in claim 11, wherein said primary detect flag and said speech detect flag are set, so that a state transition from said intermediate state does not occur, if an energy ratio of said speech is larger than a third threshold.

13. A method for suppressing noise as claimed in claim 8, further comprising the steps of:

comparing a speech energy with an estimated noise energy;

determining a gain value based on said comparison of said speech energy and said estimated noise energy;

smoothing said gain value; and suppressing background noise to said noise-corrupted signal using said smoothed gain value.

14. A method for suppressing noise as claimed in claim 8 further comprising the steps of:

computing a maximum magnitude of said noise-corrupted speech;

comparing a product of a gain and said maximum magnitude, with a first threshold; and reducing said gain if said product is larger than said first threshold.

15. A method for suppressing noise as claimed in claim 14 further comprising the steps of:

comparing a product of said gain and said maximum magnitude, with a second threshold; and increasing said gain if said product is smaller than said second threshold.

* * * * *